United States Patent [19]

Whittle

[11] 4,208,134

[45] Jun. 17, 1980

[54] APPARATUS AND METHOD FOR MIXING MATERIAL

[75] Inventor: Kenneth F. Whittle, Bridgnorth, England

[73] Assignee: Protein Foods (U.K.) Limited, Staffordshire, England

[21] Appl. No.: 765,790

[22] Filed: Feb. 4, 1977

[30] Foreign Application Priority Data

Feb. 19, 1976 [GB] United Kingdom ..... 6626/76

[51] Int. Cl.[2] ..... B01F 5/12; B01F 7/04; B01F 15/02; B01F 15/06

[52] U.S. Cl. ..... 366/147; 366/148; 366/168; 366/189; 366/196; 366/265; 366/279

[58] Field of Search ..... 259/9, 10, 26, 46, 110; 220/371, 373; 210/470, 472; 55/185; 366/194–196, 262–265, 147, 148, 168, 189, 279

[56] References Cited

U.S. PATENT DOCUMENTS

| | | | |
|---|---|---|---|
| 1,061,142 | 5/1913 | Tesla | 366/265 |
| 1,274,180 | 7/1918 | Mauch | 259/9 |
| 1,552,400 | 8/1924 | Aspden | 259/10 |
| 2,732,092 | 1/1956 | Lawrence | 220/371 |
| 3,284,056 | 2/1964 | McConnaughay | 259/10 |
| 3,390,004 | 6/1968 | Di Placido | 366/263 |
| 3,454,263 | 7/1969 | Galle | 259/9 |
| 3,606,270 | 9/1971 | Zimmerly | 366/263 |

*Primary Examiner*—Harvey C. Hornsby
*Assistant Examiner*—Timothy F. Simone
*Attorney, Agent, or Firm*—Neil F. Markva

[57] ABSTRACT

A mix for batch mixing a treatment agent and a particulate material comprises a mixing chamber having at least one mixing member rotatably mounted therein. Outlet means is positioned to receive the mixed batch of material from the mixing chamber. The mixing member may be rotated at a first speed of rotation effective to mix materials within the mixing chamber without discharging from the outlet means. The mixing member is also rotatable at a second speed of rotation effective to discharge the charge or batch of material through the outlet means after it has been treated during the initial mixing step. The rotation of the mixing member at a higher rate of speed at the second speed of rotation effects discharge through the outlet means by centrifugal force.

15 Claims, 2 Drawing Figures

APPARATUS AND METHOD FOR MIXING MATERIAL

BACKGROUND OF THE INVENTION

The present invention relates to a mixer and to a method of mixing material, for example, to a method of mixing particulate material with a treatment agent. The mixer can be used to mix particulate material with a liquid gas to thereby cool the material.

Present methods for freezing particulate material, e.g. foodstuffs, rubber and plastics objects, by liquid gas suffer from various disadvantages. Simple batch methods are time-consuming and excessively wasteful of liquid gas. Continuous conveyorized systems on the other hand require relatively expensive equipment which also occupies extensive floor area in the factory.

SUMMARY OF THE INVENTION

According to one aspect of the present invention there is provided a mixer comprising a chamber, at least one rotatable vane member mounted in the chamber, and means for rotating the vane member at at least two speeds. The chamber has an outlet positioned so that when the vane member is rotated at the higher of the two speeds material may be discharged therethrough by centrifugal force.

The mixer can be used to mix particulate material, that is, material comprising a plurality of pieces, fragments or particles.

Preferably, the chamber is substantially cyclindrical and has two radially extending vane members mounted therein. In a preferred embodiment the two vane members are diametrically opposed with respect to one another. Each vane member may be a substantially planar paddle which is substantially I-shaped. Preferably each paddle is substantially equal in length to the radius of the cylindrical chamber, whereby upon rotation each paddle sweeps substantially the entire cross-sectional area of the chamber. In addition, the width of each paddle may be substantially equal to the longitudinal extent of the cylindrical chamber whereby upon rotation each paddle sweeps substantially the entire volume of the chamber. In this way efficient mixing of the material is ensured.

In a preferred embodiment, the cylindrical chamber is provided with one or more inlet ports for a treatment agent, for example, liquid gas, and an inlet hopper for particulate material. The hopper may have a movable closure member which is permeable to the treatment agent. In addition, the outlet preferably comprises an outlet chute arranged to extend substantially tangentially to the cylindrical chamber and including an outlet closure member movable between an open and a closed position.

Preferably the chamber is insulated. For example, the chamber may be provided in a housing having a double wall construction with the space between the walls being either evacuated or filled with a heat insulating material such as cork or plastics material.

The vane members are preferably mounted on a shaft extending along the longitudinal axis of the cylindrical chamber. The shaft is driven by a drive motor connected thereto by way of gear means whereby the speed of rotation of the vane members may be varied.

In accordance with a further aspect of the present invention there is provided a method of mixing material comprising the steps of charging the chamber of apparatus as defined above with material to be mixed, rotating the vane member at a first speed for a predetermined time, and then rotating the vane member at a second, higher speed, to the material through the outlet by centrifugal force.

Preferably the material to be mixed is a particulate material and the chamber is also charged with a treatment agent for treating the material. In a preferred embodiment the treatment agent is a liquid gas for cooling the particulate material.

BRIEF DESCRIPTION OF DRAWINGS

An embodiment of the present invention will hereinafter be described, by way of example, with reference to the accompanying drawings, in which.

DESCRIPTION OF SPECIFIC EMBODIMENTS

Figure 1:
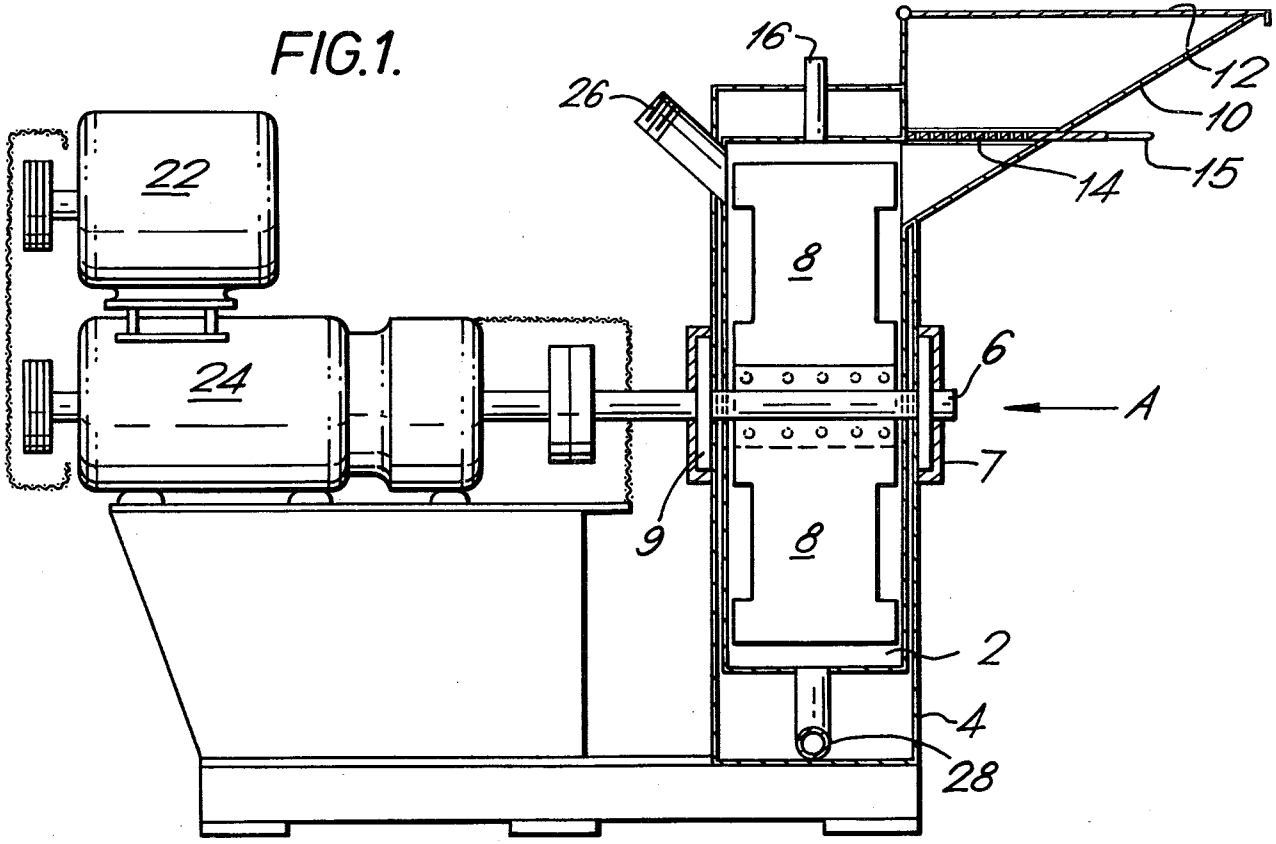
FIG. 1 shows a side view, partly in section, of a mixer of the present invention.

The drawings show a mixer of the present invention having a cylindrical chamber 2 defined within a housing 4 having a double walled construction. It will be seen that the longitudinal axis of the chamber 2 extends substantially horizontally. In the embodiment illustrated the space between the two walls of the housing 4 is filled with cork to heat insulate the chamber 2. Alternatively, the space between the walls of the housing 4 could be filled with a plastics material or could be evacuated. A driven shaft 6 extends through the chamber 2 substantially centrally thereof and is journalled in bearings 9. Thermostatically controlled heater blocks 7 are mounted around the bearings 9 to prevent seizure thereof. Two paddles 8 are fixed to the shaft 6 for rotation therewith. Each paddle 8 is substantially planar and is substantially I-shaped. The length of each paddle 8 is almost equal to but slightly less than the radius of the cylindrical chamber 2 and upon rotation each paddle 8 sweeps almost the entire cross-sectional area of the chamber 2. In addition, the width of each paddle 8 at its widest points across the top and bottom of the I-shape is substantially equal to but slightly less than the longitudinal extent of the chamber 2. In this way, as each paddle 8 is rotated by means of the shaft 6 it sweeps almost the entire volume of the cylindrical chamber 2. In the embodiment illustrated the two paddles 7 are diametrically opposed with respect to each other about the shaft 6.

An inlet hopper 10 for material to be mixed, is formed with the housing 4 and opens into the cylindrical chamber 2. This hopper 10 has a lid 12 hingedly connected thereto and a closure member 14 positioned therein and movable by handle 15 from the closed position illustrated to an open position (not shown). Preferably, this closure member 14 is made of a material permeable to the treatment agent, for example to gas evaporated from liquid gas. Alternatively, the closure member 14 has a grid structure, the holes in the grid being large enough to allow treatment agent to pass therethrough but small enough to prevent substantial passage of the material within the hopper 10. In addition, two inlet ports 16 for the treatment agent are formed in the housing 4 and extend into the cylindrical chamber 2.

Figure 2:
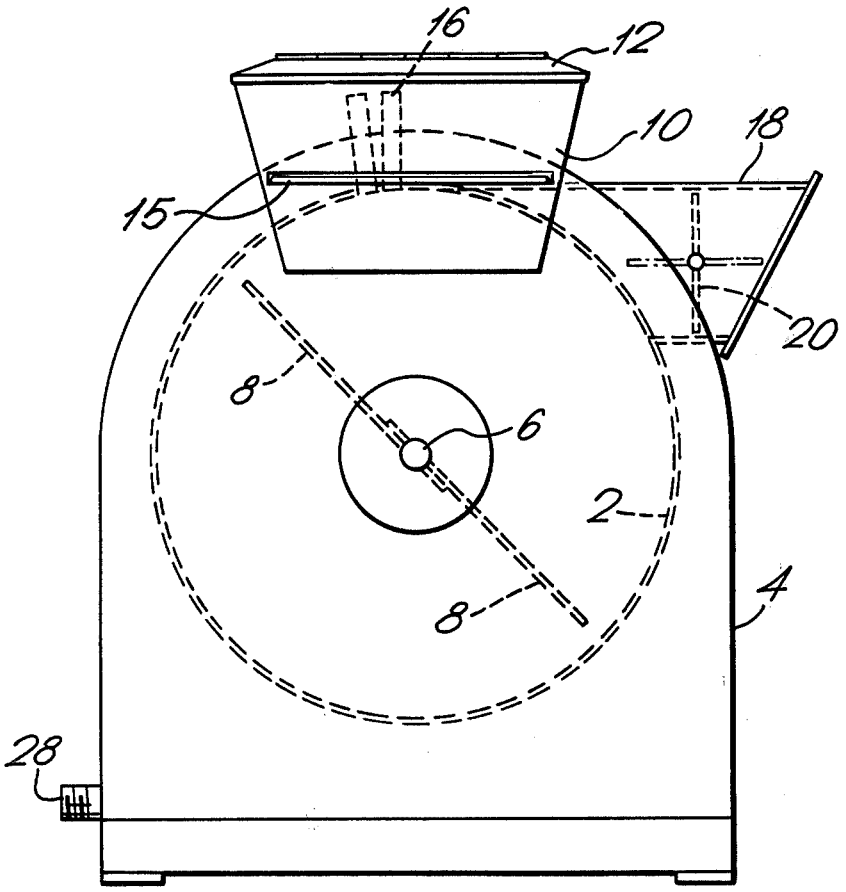
FIG. 2 shows a front view, in the direction of arrow A of FIG. 1, of the mixer of FIG. 1.

The housing 4 also has a material outlet chute 18 formed thereon. This outlet chute 18 extends substantially tangentially with respect to the chamber 2 and opens into the chamber 2. A rotatably mounted closure member 20 is provided in this chute 18 and is movable between a closed position shown in dotted lines in FIG. 2, and an open position shown in dashed lines in FIG. 2.

The shaft 6 is rotated by an electric motor 22 by way of a variable gear box 24.

If the mixer is used to cool particulate material, the particulate material is placed in the inlet hopper 10 with the closure member 14 in its closed position. The electric motor 22 is switched on and the gear box 24 is adjusted to rotate the shaft 6 at a first, low speed. The two paddles 8 are thus rotated within the cylindrical chamber 2. The mixer has been used to freeze pieces of dehydrated and defatted pork rind in liquid nitrogen and in this case it has been found that a speed of rotation for the paddles of approximately 20 r.p.m. is appropriate. Of course, the speed of rotation of the paddles can be chosen as required in accordance with the nature of the material to be cooled in the apparatus.

The closure member 14 in the inlet hopper 10 is then moved to its open position so that material from the inlet hopper 10 is fed by gravity into the cylindrical chamber 2. At the same time a supply of liquid gas, e.g. nitrogen, is connected to one or more of the inlet ports 16. The rotation of the paddles 8 mixes the liquid gas with the material from the inlet hopper 10 so that the material is cooled thereby. While the cooling process is continuing, the closure member 14 in the inlet hopper 10 is moved back into its closed position and a further charge of material is placed in the hopper 10 and the lid 12 is then closed. As the closure member 14 is permeable to gas any gas evaporating in the chamber 2 will rise through the closure member 14 and be partially mixed with the fresh charge of material. In this way the fresh charge of material will be partially cooled before it enters the chamber 2 and thus the time the material has to remain in the cylindrical chamber 2 can be reduced.

When the cooling process has been completed, that is after a predetermined time, or when the charge or batch of material has been brought to a predetermined low temperature, the gear box 24 is adjusted so that the shaft 6 is rotated at a second, higher speed. At the same time, the closure member 20 in the outlet chute 18 is moved from its closed position into an open position. As the paddles 8 rotate at the higher speed, for example, at 200 r.p.m., they act as a centrifuge and throw out the cooled charge or batch of material through the outlet chute 18 by centrifugal force. Generally, the supply of liquid gas to the inlet ports 16 will be shut off when the cooling process has been completed.

When the cylindrical chamber 2 has been emptied of the cooled material the gear box 24 is again adjusted to drive the shaft 6 at the lower, mixing speed and a fresh charge of material is allowed to feed into the chamber 2 by opening the closure member 14 in the inlet hopper 10. The supply of liquid gas to the inlet ports 16 is switched on again and the process is thus repeated. It will thus be seen that large quantities of material may be easily and quickly cooled using this apparatus. A container, bag or the like can be positioned at the outlet chute 18 to collect the cooled material.

As is shown in the drawings a cleaning port 26 and a drain port 28 are provided so that the chamber 2 may be cleaned when required. Cleaning fluid, for example, water under pressure, is supplied to the chamber 2 through the cleaning port 26 and is flushed out through the drain port 28. At the same time, the paddles 8 may be rotated at a slow speed so that the cleaning fluid flushes out any material remaining in the cylindrical chamber 2.

The mixer described above is particularly useful in the manufacture of a dehydrated, bacteriologically-stable pork rind product by the process described in British Patent Specification No. 1,420,960. The material placed in the inlet hopper 10 would then comprise pieces of pork rind which have been treated to dehydrate them and to lower the fat content thereof. The material is then rapidly cooled in the mixer described above until frozen. Preferably, the pieces of pork rind are mixed with liquid nitrogen in the chamber 2 for between 3 to 6 minutes. The material then collected at the outlet chute 18 is sufficiently frozen and brittle to enable it thereafter to be rapidly and effectively ground.

Of course, the mixer can be used to cool or freeze materials other than the pork rind referred to, for example, other foodstuffs, rubber objects or objects made of plastics material.

The mixer has been described above with particular reference to the cooling of particulate material with a liquid gas. It will be seen, however, that the mixer could also be used to heat particulate material, for example, with a heated gas or steam. Alternatively, the mixer could be used to mix material, for example particulate material. The mixer has been found to work most effectively with a particulate material having pieces or particles which are small as compared to the overall volume of the chamber. The rotatable vane members could also be formed as blades if required.

The mixer has the advantage that large throughputs of material can be quickly and easily mixed in a continuous process and that the amount of physical handling of the material is reduced to a minimum.

I claim:

1. A mixer assembly for batch mixing a treatment agent and a particulate material, said assembly comprising:

(a) a mixing chamber having at least one mixing member rotatably mounted therein, (b) the mixing member being rotatable at a first, mixing speed of rotation and at a second, discharging speed of rotation greater than said first speed of rotation, (c) means for rotating the mixing member to mix a batch mixture of particulate material and treatment agent at said first mixing speed without discharging material from the mixing chamber, (d) said rotating means being effective to operate at said second discharging speed of rotation greater than said first speed of rotation after the mixing of the batch to discharge said batch mixture, and (e) outlet means being positioned on said chamber to receive material from the mixing chamber when the mixing member is rotated at said second, discharging speed of rotation.

2. An assembly as defined in claim 1 wherein said outlet means includes an outlet chute extending substantially tangentially with respect to said mixing chamber.

3. An assembly as defined in claim 1 wherein said mixing chamber is substantially cylindrical, said mixing member extends radially with respect to said chamber and has a length substantially equal to the radius of the cylindrical chamber, said mixing member being effective to sweep substantially across the entire cross-sectional area of the chamber upon rotation thereof.

4. An assembly as defined in claim 3 wherein the width of the mixing member is substantially equal to the longitudinal extent of the cylindrical chamber whereby upon rotation, the mixing member sweeps substantially the entire volume of said chamber.

5. An assembly as defined in claim 1 wherein said mixing members comprise two radially extending vane members rotatably mounted in a chamber having a substantially cylindrical configuration.

6. An assembly as defined in claim 1 wherein said mixing member is a substantially planar paddle having a substantially eye-shaped outer profile configuration.

7. An assembly as defined in claim 1 wherein said chamber includes at least one inlet port means for introducing treatment agent into said chamber, said chamber further having an inlet hopper means for introducing particulate material into said chamber.

8. An assembly as defined in claim 7 wherein said inlet hopper means includes an inlet closure member movable between an open position and a closed position.

9. An assembly as defined in claim 8 wherein said inlet closure member is permeable to a gaseous treatment agent while in the closed position, said closure member being effective to prevent said particulate material from entering into the chamber while in said closed position.

10. An assembly as defined in claim 7 wherein said inlet port means includes means for introducing liquid nitrogen into said mixing chamber.

11. An assembly as defined in claim 1 wherein said mixing chamber is insulated by an amount sufficient to maintain an appropriate temperature within said mixing chamber during the operation of said assembly.

12. An assembly as defined in claim 1 wherein said outlet means includes an outlet chute extending outwardly from said chamber and a closure means movable between a closed position and an open position of said outlet means.

13. A method of mixing material comprising the steps of:

(a) providing an assembly including a mixing chamber having a mixing member, outlet means and means for rotating said mixing member, (b) rotating said mixing member at a first speed of rotation, (c) introducing a batch of treatment agent and particulate material to be mixed together to form a treated batch mixture while said mixing member is rotated at said first rotational speed, then (d) rotating said mixing member at said second higher speed of rotation to discharge the treated batch mixture through said outlet means.

14. A method as defined in claim 13 wherein said treatment agent is a liquid gas effective to cool said particulate material.

15. A method as defined in claim 14 wherein said particulate material is pork rind and said cooling gas is liquid nitrogen.

* * * * *